US006439488B1

(12) United States Patent
Hunter

(10) Patent No.: US 6,439,488 B1
(45) Date of Patent: Aug. 27, 2002

(54) TENSIONING DEVICE FOR CIRCULAR KNITTING MACHINE

(76) Inventor: Bobby Hunter, 300 Legrande Blvd., Greenville, SC (US) 29607

( * ) Notice: Subject to any disclaimer, the term of this patent is extended or adjusted under 35 U.S.C. 154(b) by 0 days.

(21) Appl. No.: 09/723,119

(22) Filed: Nov. 27, 2000

(51) Int. Cl.[7] ..... B65H 59/22; B65H 59/12

(52) U.S. Cl. ..... 242/150 R; 242/147 M; 242/150 M; 242/153; 242/419.3; 242/419.4

(58) Field of Search ..... 242/150 M, 150 R, 242/153, 155 M, 147 M, 419.3, 419.4, 485

(56) References Cited

U.S. PATENT DOCUMENTS

| | | | | | |
|---|---|---|---|---|---|
| 2,581,142 | A | | 1/1952 | Rea | 242/154 |
| 3,100,091 | A | | 8/1963 | Mindheim et al. | 242/150 |
| 3,206,138 | A | | 9/1965 | Lindsey | 242/150 |
| 3,848,434 | A | * | 11/1974 | Hopkins | 66/163 |
| 3,991,954 | A | | 11/1976 | Schwartz | 242/150 M |
| 4,313,578 | A | * | 2/1982 | Van Wilson et al. | 242/150 M X |
| 4,535,609 | A | | 8/1985 | Goller et al. | 66/146 |
| 4,752,044 | A | * | 6/1988 | Memminger et al. | 242/365.7 |
| 4,768,729 | A | * | 9/1988 | Jacobsson | 242/150 R X |
| 5,238,202 | A | | 8/1993 | Sheehan et al. | 242/150 M |
| 5,301,895 | A | * | 4/1994 | Sheehan et al. | 242/150 M |
| 5,335,878 | A | | 8/1994 | Jacobsson | 242/150 R |
| 5,343,983 | A | | 9/1994 | Horvath et al. | 188/65.1 |
| 5,560,557 | A | * | 10/1996 | Horvath et al. | 242/150 M X |
| 5,927,629 | A | * | 7/1999 | Dixon | 242/150 R |
| 5,979,810 | A | | 11/1999 | Barth | 242/150 |
| 6,065,711 | A | | 5/2000 | Plath | 242/419.4 |

* cited by examiner

*Primary Examiner*—Michael R. Mansen
*Assistant Examiner*—Minh-Chau Pham
(74) *Attorney, Agent, or Firm*—McNair Law Firm, P.A.

(57) ABSTRACT

A textile machine for processing yarn including a yarn tensioning device comprising a generally C-shaped frame having a generally vertical leg carrying generally parallel and horizontal arms in spaced positions along one side thereof each having a yarn guide. A pair of tensioning disks are rotably carried by the leg intermediate of the eyes. The disks are continuously urged into mutual contact. A mounting block is carried by the textile machine. A pair of connectors carried by the mounting block and frame are adapted to removably secure the frame with the mounting block. Yarn drawn through the tensioning device is maintained under proper tension as it passes through the disk while the disks are carried to rotate by movement of the yarn into the textile machine, which rotation frees the disks of lint thus maintaining uniform tension on the yarn.

9 Claims, 3 Drawing Sheets

TENSIONING DEVICE FOR CIRCULAR KNITTING MACHINE

BACKGROUND OF THE INVENTION

The instant invention is directed to a yarn tensioning device for use with textile machine such as looms, tufting machines, and knitting machines.

Tensioning devices are old and well known as illustrated in U.S. Pat. Nos. 5,238,202; 5,343,983; and 5,979,810. Each of these patents include disk which are magnetically attracted.

The instant invention is an improvement over the above referred to devices and includes structures not taught therein.

The instant invention has as an object a yarn tensioning device which is easily mounted with the textile fabricating machine and in which the tension is easily changed.

Another object of the invention is a tensioning device formed substantially of molded plastic.

Another object of the invention is a tensioning device in which the tensioning disks rotate during yarn movement which motion acts to clean the disks of lint.

Another object of the invention is a tensioning device which includes a yarn detector.

Another object of the invention is a multi-component mounting structure for a yarn tensioning device.

Another object of the invention is a tensioning device in which detachable connecting elements connect the components in operating positions.

Another object of the invention is a yarn tensioning device in which the inner surfaces of the disks remain free of lint during use.

Another object of the invention is the use provision of a low cost selfcleaning yarn tensioning device.

SUMMARY OF THE INVENTION

The instant invention is directed to a yarn tensioning device for use with textile machines. The tensioning device comprises a support frame having a pair of eyes with a pair of tensioning disk positioned there between. The tensioning disk are urged into mutual engagement preferably by magnets. A lug which extends from the frame is formed with a wedge shaped groove on one side thereof.

A mounting block is secure with the textile machine by way of connectors. The mounting block carries a wedge shaped extension which is adapted to secure with the wedge shaped groove carried by the lug. In use the connectors secure the mounting block with the textile machine while the wedge shaped groove and extension are united and positioned to receive yarn being fed to the textile machine.

The mounting block includes a pair of horizontally spaced arms which are arranged beneath the eyes and tensioning disk. The mounting block arms carry yarn detector lenses.

The support frame includes an elongated leg with arms arranged substantially perpendicular thereto in spaced positions. Each arm carries one of the eyes. A plate is carried by the upper arm.

A textile machine for processing yarn having a yarn tensioning device which comprises a generally C-shaped support frame having a generally vertical leg with generally parallel and horizontal arms extending from opposed ends one side thereof. A first connecting member is also formed with the vertical leg. A yarn guide eye is carried in each of the upper and lower arms. A pair of tensioning disks are carried by the vertical leg intermediate of the eyes. The disks are urged into mutual contact.

A mounting block is carried by the textile machine and includes a second connecting member which is adapted to secure with the first connecting member. The connecting members removably secure support frame with the mounting block. The yarn being processed is maintained under proper tension as it passes sequentially through the eye carried by said upper arm, between the tensioning disk, through the eye carried by the lower arm through the mounting block and through the textile machine because the disk rotate during yarn delivery maintaining their yarn engaging faces free of lint and other debris. A yarn sensing apparatus is carried by the mounting block which is operative to sense the absence of yarn which triggers stoppage of the textile machine.

Preferably the first and second connecting members comprise a wedge shaped extension which is engagable with a wedge shaped groove.

Preferably the tensioning device is arranged with the yarn guide eyes axially aligned along a first axis with the disks being laterally spaced from the axis. The disks are rotably mounted so that yarn passing through the eyes and the disk maintain the disk aligned with the eyes and causes the disk to rotate.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The instant invention as shown in FIGS. 1–4 is directed to a yarn tensioning device 10 for use with textile fabricating machines, particularly circular knitting machines. In its intended environment, tensioning device 10 is secured with the frame of the textile machine in position to receive yarn 14 from yarn guide 16. Yarn 14 passes generally vertically downward through tensioning device 10 and into the textile machine where it is further processed primarily into knit goods. Tensioning device 10 acts to maintain yarn 14 under a constant tension during such processing. Tensioning device 10 also carries lenses or reflectors for use with a stop apparatus or yarn detector. The stop apparatus acts to detect a break or an interruption of yarn during processing at which time the stop apparatus acts to bring about a stop of the machine operation.

Figure 1:
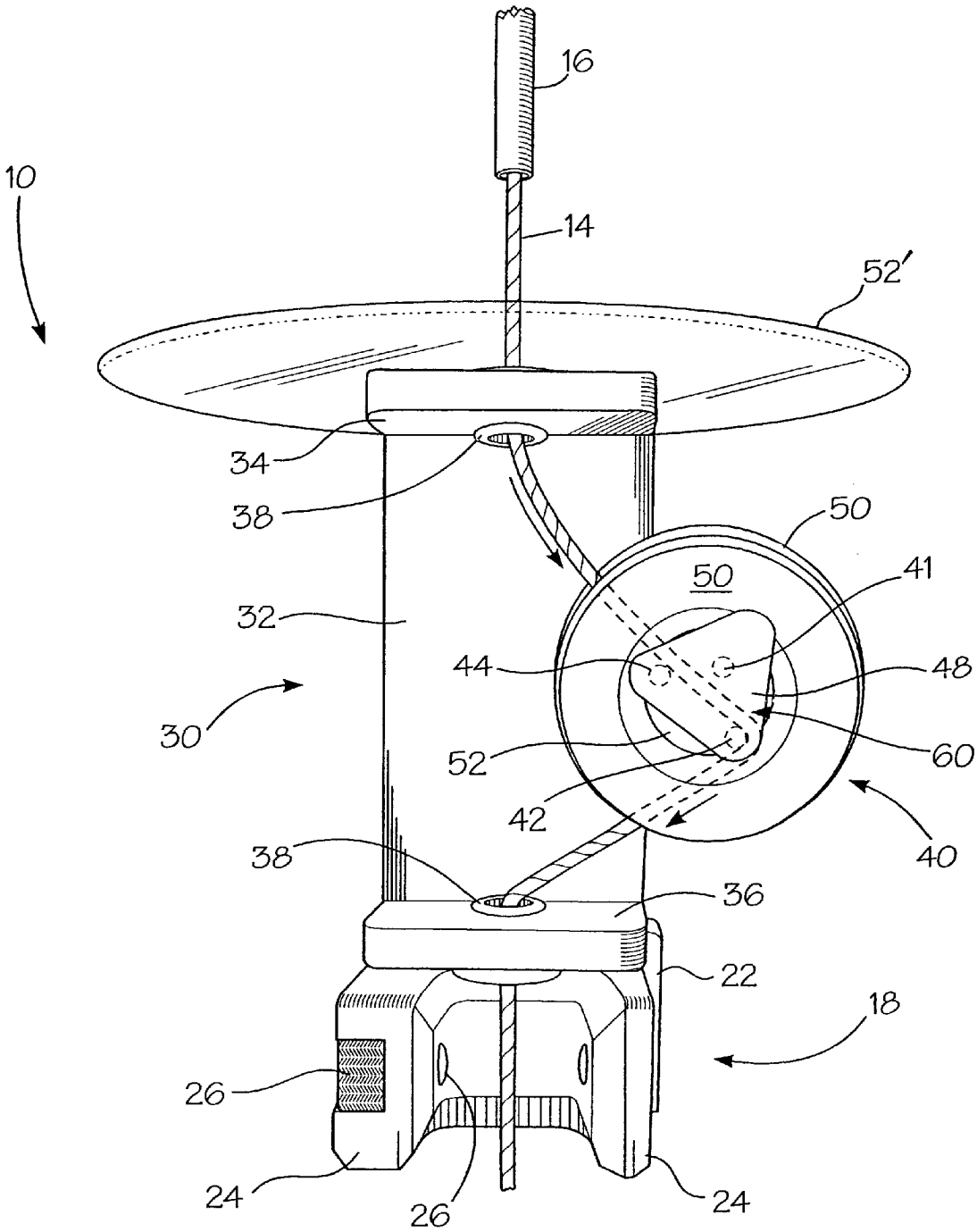
FIG. 1 is a front view of the yarn tensioning device of the invention.
Figure 2:
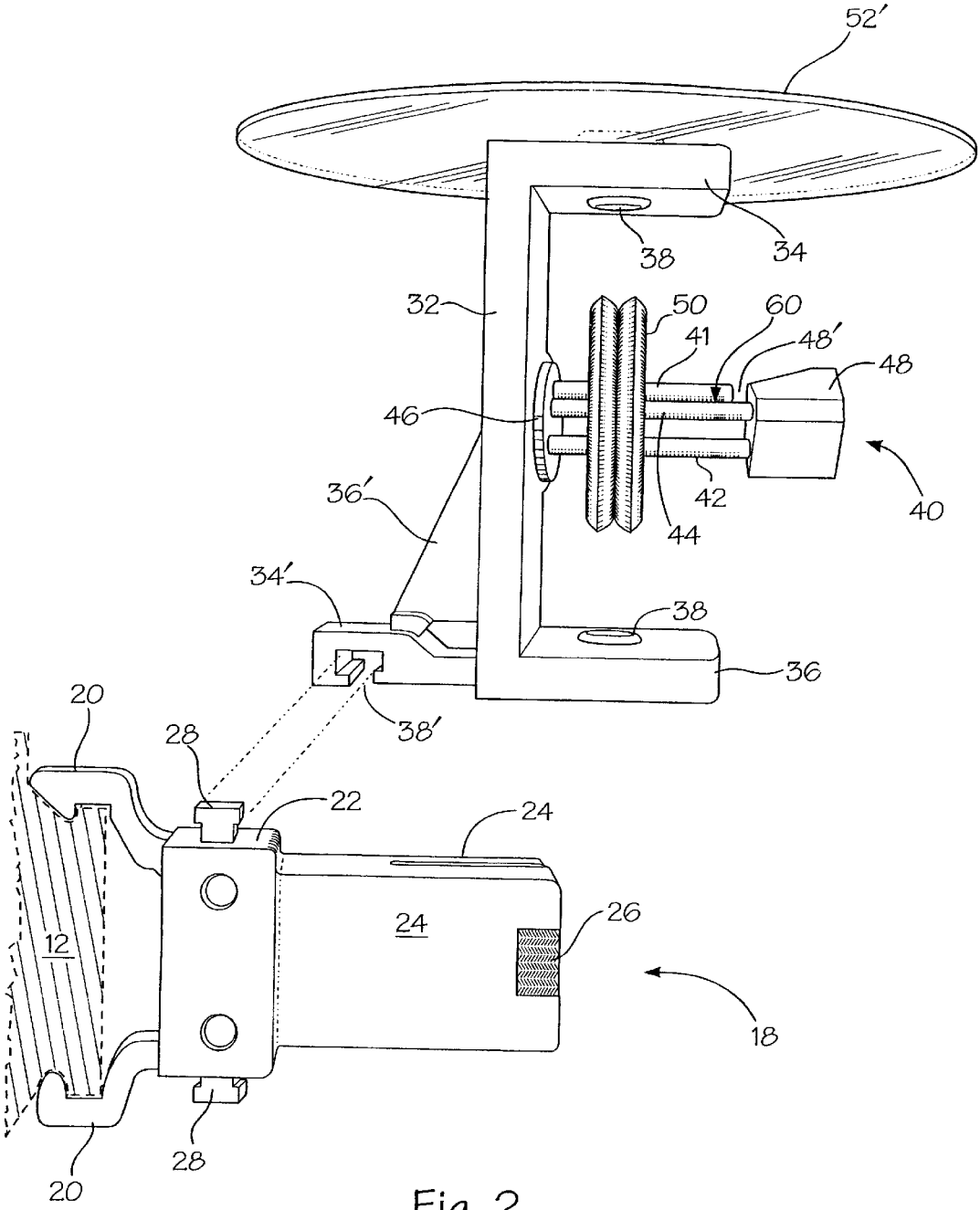
FIG. 2 is an exploded right side view.
Figure 3:
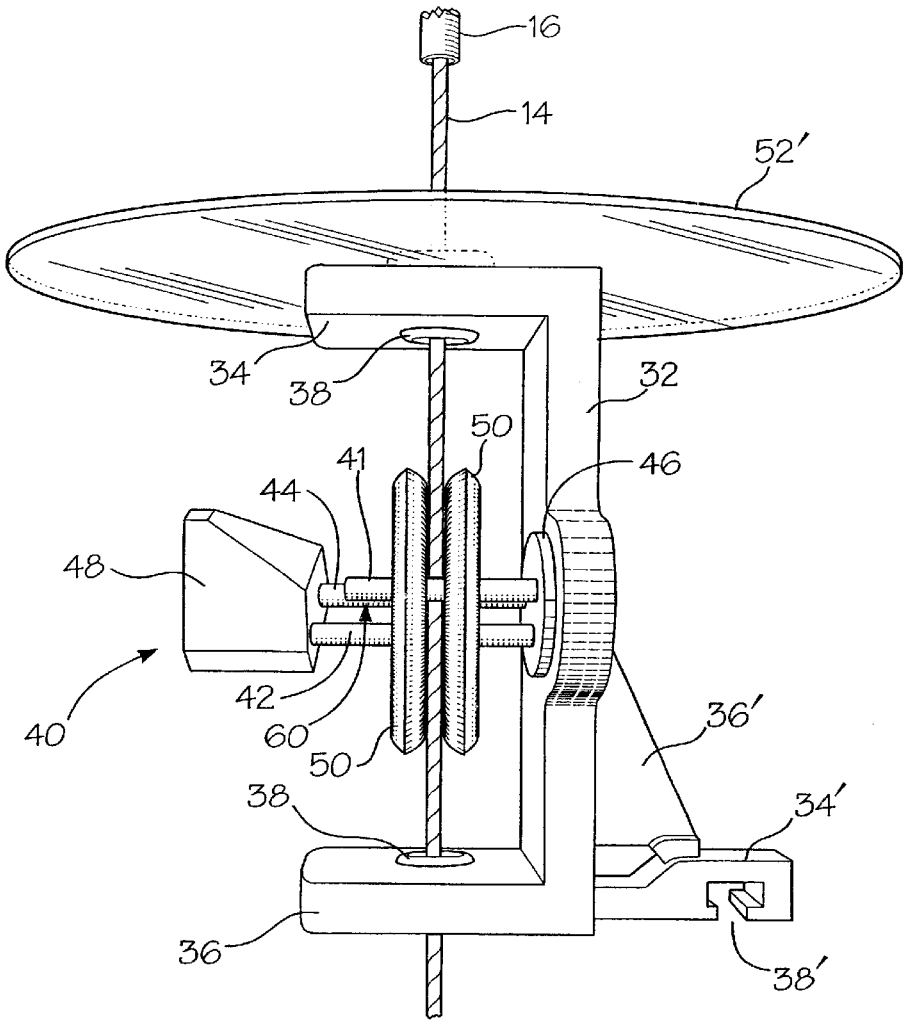
FIG. 3 is a left side view.
Figure 4:
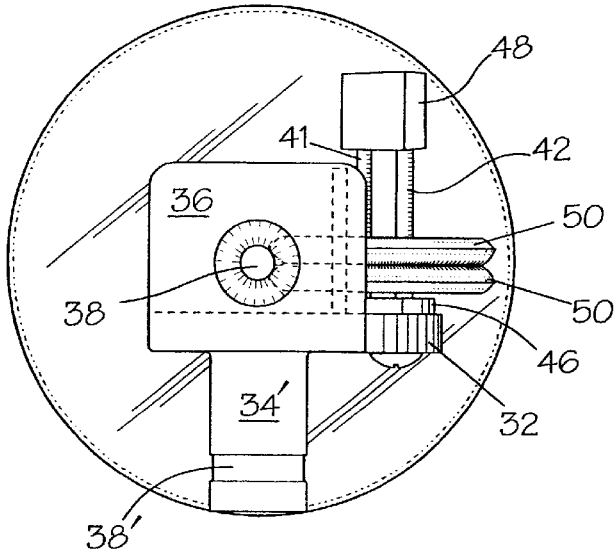
FIG. 4 is a bottom view of FIG. 3.

As shown in FIGS. 1 and 2 tensioning device 10 includes a mounting block 18 which is secured with textile machine 12 by mounting lugs 20. Mounting block 18 includes a body 22 which mounts on one side lugs 20 and on its opposite side a pair of spaced parallel arms 24. Arranged in arms 24 are lenses 26 which are operative to receive and direct a beam from an electronic yarn detector across the path traveled by yarn 14 as it passes into the textile machine. The detector, of which the lenses are a part, is operative to detect an absence of yarn and to bring about a machine stop as a result of such detection. Such type of devices are common and as such form no part of the instant invention. The structure carrying and the arrangement of lenses 26 with block 18 is a part of this invention.

Mounting block 18 also includes a wedge shaped extension 28 mounted on the upper and lower edges of body 22. The extensions are designed to engage with support frame 30 of tensioning device 10 to secure it with mounting block 18. There are upper and lower wedge shaped extensions 28 to insure that the beam receiving lens of lenses 26 may always be positioned in a direction to receive the light beam from the electronic yarn detector mechanism.

Support frame 30 comprises an elongate leg 32 which has formed on one side a mounting lug 34' which extends generally perpendicularly of the axis of leg 32. If desired, a brace 36' may connect longitudinally of the side of leg 32 and along the top of lug 34' to provide additional stability. Formed in the lower surface of lug 34' is a wedge shaped groove 38'. Groove 38' is constructed to engage with wedge-shaped extension 28 to removably lock support frame 30 with mounting block 18. It is noted that grooves may be formed with mounting block 18 and the wedges with support frame 30, if desired.

Elongated leg 32 is formed with perpendicularly extending arms 34 and 36 extending from its upper and lower extremities and from the side opposite lug 34'. Each arm 34, 36 includes an eye 38 for receiving and guiding yarn 14 through the tensioning device. Arms 34 and 36 are preferably parallel and eyes 38 are preferably arranged along a common vertical axis.

A disk mount 40 is secured with leg 32 at base 46 with suitable means such as a screw and generally intermediate of eyes 38 but laterally spaced from the axis along which they are positioned. Mount 40 includes three yarn guide pins 41, 42, 44 each secured at one end with base 46. Cap 48 secures with the opposite ends of pins 42 and 44 with pin 41 being slightly spaced therefrom forming opening 60' which leads to yarn guide path.

A pair of magnetic disk 50 having center openings 52 are mounted on pins 41, 42, 44 to be both rotable and axially movable. Magnetic disk 50 are known, therefore further description thereof is not deemed necessary. The disk shown in FIG. 7 and described in U.S. Pat. No. 5,343,983 are representative of disk 50. Disk 50 are attracted toward each other with the degree of attraction determining the tension applied on the yarn. The tension may be varied by simply exchanging support frames 30 or disk mounts 40.

Mounted on the upper surface of arm 34 is plate 52'. Plate 52' which has a radius of between one and two inches is positioned with its center opening aligned with eyes 38. Plate 52 is designed as a support surface in the event of yarn overfeed which occurs with each change in yarn being fed.

In operation, mounting block 18 is secured with the knitting machine with arms 24 extending along a generally horizontal plane. Support frame 30 is secured with mounting block 18 with eyes 38 in general vertical alignment beneath feed 16.

Yarn 14, as it is drawn into the fabricating machine, passes downward through feed 16, through upper eye 38, deflects to one side to pass between disk 50 over pin 44, beneath pin 41, about pin 42, deflects back to its original alignment to pass through lower eye 38, through arms 24, past lens 26, and on to the textile machine, i.e. usually a circular knitting machine but it could be a flat knitting machine, a tufting machine, or a loom. The tension on the yarn along with the position of eyes 38 maintains disks 50 generally equally spaced from cap 48 and base 46.

As yarn 14 is drawn through disks 50 the movement causes the disks to rotate which action throws any lint or dust being deposited on the disk from the yarn movement outward and away from the inner yarn contacting surfaces of the disks. Because disks 50 are spaced both from base 46 and cap 48, lint and dust also is thrown from the outsides of the disks. This action provides for extended running time, i.e. time between stops to clean dust from the yarn feed system. Also, it provides for even tension on the yarn being fed. Lint build-up between the disk causes a decrease in tension on the yarn which in turn causes a variation, usually an increase, in stitch size in the fabric being formed.

While a preferred embodiment of the invention has been described using specific terms, such description is for illustrative purposes only, and it is to be understood that changes and variations may be made without departing from the spirit or scope of the following claims.

What is claimed is:

1. A textile machine for processing yarn including a self-cleaning tensioning device for tensioning yarn moving into said machine comprising:

a generally C-shaped frame having a generally planar leg carrying generally parallel upper and lower arms extending generally perpendicular of said leg and in spaced positions along one side thereof, and a first connecting member;

a first yarn guide eye carried by the upper of said arms and a second yarn guide eye carried by the lower of said arms, said first and second yarn guide eyes being arranged along a common axis;

a pair of tensioning disks rotably carried by said leg intermediate of said eyes and laterally of said common axis, said disks being urged into mutual contact;

a mounting block carried by said textile machine, said mounting block having a second connecting member adapted to secure with said first connecting member to removably secure said frame with said textile machine; wherein, said yarn sequentially passes generally along said common axis through said first eye, laterally of said common axis between said pair of disks, back to generally along said common axis through said second eye and said mounting block into said machine, movement of said yarn through said tensioning disks causing said disks to be rotated and cleaned of lint.

2. The machine of claim 1 including yarn sensing apparatus carried by said mounting block beneath said second guide eye said yarn being sensed as it passes through said mounting block.

3. The machine of claim 1 wherein said frame and said mounting block are molded plastic.

4. The machine of claim 1 wherein said first and second connecting members comprise a wedge shaped extension engagable with a wedge shaped groove.

5. The machine of claim 1 wherein said disks are rotably mounted on a disk mount and yarn guide, said yarn passing through said yarn guide.

6. The machine of claim 1 including a plate carried above said upper of said arms.

7. A self-cleaning yarn tensioning device for use with a knitting machine comprising:

a frame comprising an elongated leg arranged along a first axis;

an upper arm, having a first yarn guide eye, extending from one end and generally perpendicularly of said elongated leg;

a lower arm, having a second yarn guide eye, extending from a second end and generally perpendicularly of said elongated leg;

said first and second guide eyes being aligned along a second axis laterally spaced from and generally parallel with said first axis;

a disk mount and yarn guide arranged laterally of said second axis, intermediate of said first and second yarn guide eyes along a third axis generally perpendicular of said first and second axis;

first and second magnet disks, having opposing yarn engaging inner faces, rotably carried by said disk mount and yarn guide, said inner faces extending along a plane generally parallel and aligned with said second axis, said inner faces being magnetically attracted toward each other; wherein yarn moving through said first guide eye, between said opposed faces and through said disk mount and yarn guide and through said second guide eye is placed under proper tension by said magnetic forces interacting with said disks while said yarn movement causes said disks to rotate causing lint and dust discarded thereon to be thrown outwardly away from said disks allowing said disks to remain lint and dust free and to maintain uniform tension on the yarn.

8. The tensioning device of claim 7 including a mounting lug carried by said elongated leg opposite one of said upper and lower arms;

a mounting block carried by said knitting machine; and connectors associated with said mounting lug and mounting block for interconnecting said tensioning device with said knitting machine.

9. The tensioning device of claim 8 wherein said connectors comprise one of a wedge and a groove.

* * * * *